US006264308B1

(12) United States Patent
Shimada

(10) Patent No.: US 6,264,308 B1
(45) Date of Patent: Jul. 24, 2001

(54) DIRECT PRINTING APPARATUS

(75) Inventor: Hirokatsu Shimada, Machida (JP)

(73) Assignees: Minolta Co., Ltd., Osaka (JP); Array Printers AB, Vastra Frolunda (SE)

( * ) Notice: Subject to any disclaimer, the term of this patent is extended or adjusted under 35 U.S.C. 154(b) by 0 days.

(21) Appl. No.: 09/265,306

(22) Filed: Mar. 9, 1999

(30) Foreign Application Priority Data

Mar. 12, 1998 (JP) ..... 10-061063

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 293, 294, 295

(56) References Cited

U.S. PATENT DOCUMENTS 5,477,250 12/1995 Larson ..... 347/55
6,086,186 * 7/2000 Bergman et al. ..... 347/55

FOREIGN PATENT DOCUMENTS 6-297753 10/1994 (JP) .

* cited by examiner

*Primary Examiner*—John Barlow
*Assistant Examiner*—Raquel Yvette Gordon
(74) *Attorney, Agent, or Firm*—Morrison & Foerster LLP

(57) ABSTRACT

The present invention provides a direct printing apparatus which prevents image noise from generating due to adhesion of toner to a spacer and enables to form a good image even if the apparatus is operated for a long period. The direct printing apparatus comprises a bearing member 30 for bearing printing particles 38 thereon, the printing particles 38 being charged to a predetermined polarity, a backing electrode 44 opposed to the bearing member 38, and a printing head 50 disposed between the bearing member 30 and the backing electrode 44. The printing head 50 has a plurality of apertures 56 through which the printing particles 38 can propel and a plurality of electrodes 68, 70 disposed around the plurality of apertures 56. The printing particles 38 are directly deposited on a print medium 8 which is conveyed between the backing electrode 44 and the printing head 50. A positioning spacer 90 is provided between the bearing member 30 and the printing head 50 so that the surface of the bearing member 30 comes into contact with the spacer 90. At least a part of the spacer 90 which comes into contact with the bearing member 30 is made of a material which is apt to be worn by the printing particles 38.

3 Claims, 4 Drawing Sheets

DIRECT PRINTING APPARATUS

This application is based on application No. H10-61063 filed in Japan on Dec. 22, 1997, the content of which is hereby incorporated by reference.

FIELD OF THE INVENTION

The present invention relates to a direct printing apparatus for use in a color or monochrome copying machine, printer, facsimile and composite thereof.

BACKGROUND OF THE INVENTION

U.S. Pat. No. 5,477,250 issued on Dec. 19, 1995 discloses a direct printing apparatus. In the direct printing apparatus, four printing stations are disposed along a sheet conveying direction. Each printing station comprises a toner carrier retaining toner on its outer periphery, a backing electrode opposed to the toner carrier and a printing head disposed between the toner carrier and the backing electrode, the printing head having a plurality of apertures and a plurality of electrodes surrounding each aperture. The backing electrode of each printing station is electrically connected to a power source, thereby between the toner carrier and the backing electrode is formed an electric field for attracting the toner on the toner carrier and propelling it toward the backing electrode through the apertures of the printing head. Between the printing head and the backing electrode in each printing station is formed a passage for a sheet.

When an ON voltage is applied to the electrode of the printing head in the printing station, the toner attracting force due to the electric field between the toner carrier and the backing electrode propels the toner on the toner carrier through the apertures toward the backing electrode and adheres it to the sheet. When an OFF voltage is applied to the electrode of the printing head, the toner attracting force does not affect the toner on the toner carrier, whereby the toner is never propelled. Thus, when ON and OFF voltage applied to the electrode of the printing head are controlled on the basis of a desired image signal, an image corresponding to the image signal is printed on the sheet.

In the aforementioned direct printing apparatus, a distance between the printing head and the toner carrier affects the flying distance of the toner. Thus, the distance between the printing head and the toner carrier necessitates an allowance of approximately 10 $\mu$m, thereby high accuracy is required. Conventionally, for example, in Japanese patent Laid-open publication 6-297753, as means for positioning the printing head and the toner carrier (developing roller) to ensure the accuracy of the position, there has been provided a spacer made of resin between the printing head and the developing roller such that the spacer comes into contact with the developing roller.

However, the aforementioned direct printing apparatus has the following disadvantage. Since the spacer comes into contact with the developing roller, the toner particles enter and accumulate in the contact portion therebetween. Thus, the heat due to the long time operation of the apparatus causes the accumulated toner particles to gradually deteriorate and melt to adhere to the surface of the spacer. Then, the adhered toner provide noise to the thin uniform layer of toner particles formed on the outer periphery of the developing roller and disturb the uniform layer, whereby noise appear on the printed image.

SUMMARY OF THE INVENTION

Accordingly, the present invention has been accomplished to solve the aforementioned disadvantages of the prior arts.

An object of the present invention is to provide a direct printing apparatus which is possible to form fine image without causing noise due to the adhesion of the toner to the spacer for long time operation.

In order to achieve the aforementioned object, according to the present invention, there is provided a direct printing apparatus which comprises a bearing member for bearing printing particles thereon, the printing particles being charged to a predetermined polarity, a backing electrode 44 opposed to the bearing member, and a printing head disposed between the bearing member and the backing electrode, the printing head having a plurality of apertures through which the printing particles can propel and a plurality of electrodes disposed around the plurality of apertures, whereby the printing particles are directly deposited on a print medium which is conveyed between the backing electrode and the printing head, wherein:

- a positioning spacer is provided between the bearing member and the printing head so that the surface of the bearing member comes into contact with the spacer; and
- at least a part of the spacer which comes into contact with the bearing member is made of a material which is apt to be worn by the printing particles.

Preferably, the part of the spacer which comes into contact with the bearing member may be made of such a material that maximum wearing depth per unit moving distance of the bearing member is more than $2.0\times10^{-3}$ $\mu$m/m.

In the direct printing apparatus of the present invention having such construction as described above, since the contact part of the spacer with the bearing member is made of such material that is apt to be worn by the printing particles, the spacer is worn away by the printing particles. Thus, the toner particles neither accumulate on the contact part nor adhere to the surface of the spacer.

Preferably, the bearing member may comprise an endless sleeve for bearing the printing particles thereon and a drive roller having outer diameter smaller than the inner diameter of the sleeve and being disposed in the sleeve.

BRIEF DESCRIPTION OF THE DRAWINGS

Further objects and advantages of the present invention will be become clear from the following description taken in conjunction with the preferred embodiments thereof with reference to the accompanying drawings, in which FIG. 1 a schematic cross-sectional side elevational view of a first embodiment of a tandem type direct printing apparatus of the present invention.

DETAILED DESCRIPTION OF THE PREFERRED EMBODIMENTS

Figure 1:
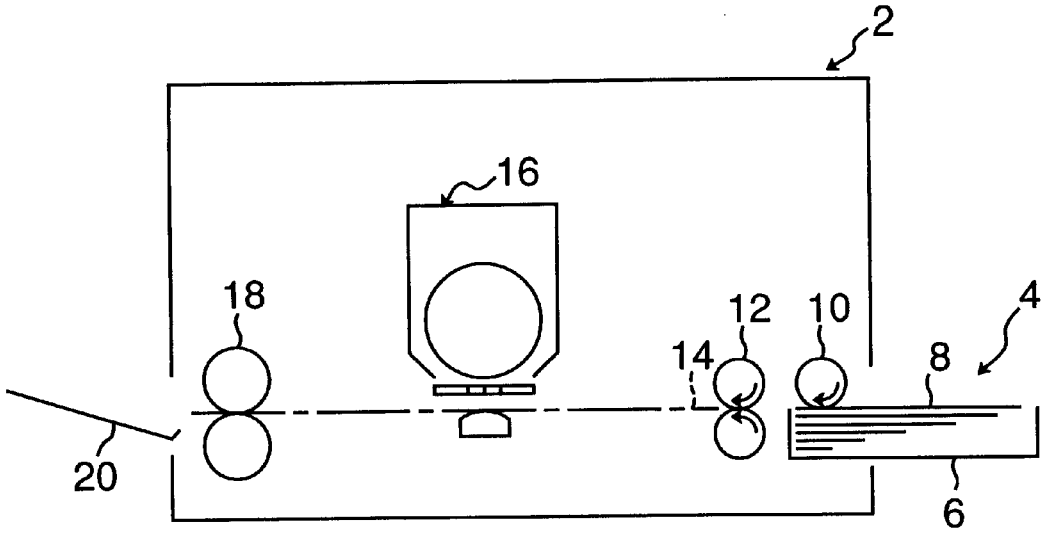

With reference to the drawings and, in particular, to FIG. 1, there is shown a direct printing device, generally indicated by reference numeral 2, according to the first embodiment of the present invention. The printing device 2 has a sheet feed station generally indicated by reference numeral 4. The sheet feed station 4 includes a cassette 6 in which a number of sheets 8 or plain papers are stacked. A sheet feed roller 10 is mounted for rotation above the cassette 6 so that it can frictionally contact with the top sheet 8, thereby the feed roller 10 can feed the top sheet 8 into the direct printing device 2 as it rotates. A pair of timing rollers 12 are arranged adjacent to the sheet feed roller 10, for supplying the sheet 8 fed from the cassette 6 through a sheet passage 14 indicated by a dotted line into a printing station, generally indicated by reference numeral 16, where a printing material is deposited on the sheet to form an image thereon. Further, the printing device 2 includes a fusing station 18 for fusing and permanently fixing the image of printing material on the sheet 8, and a final stack station 20 for catching the sheets 8 on which the image has been fixed.

Figure 2:
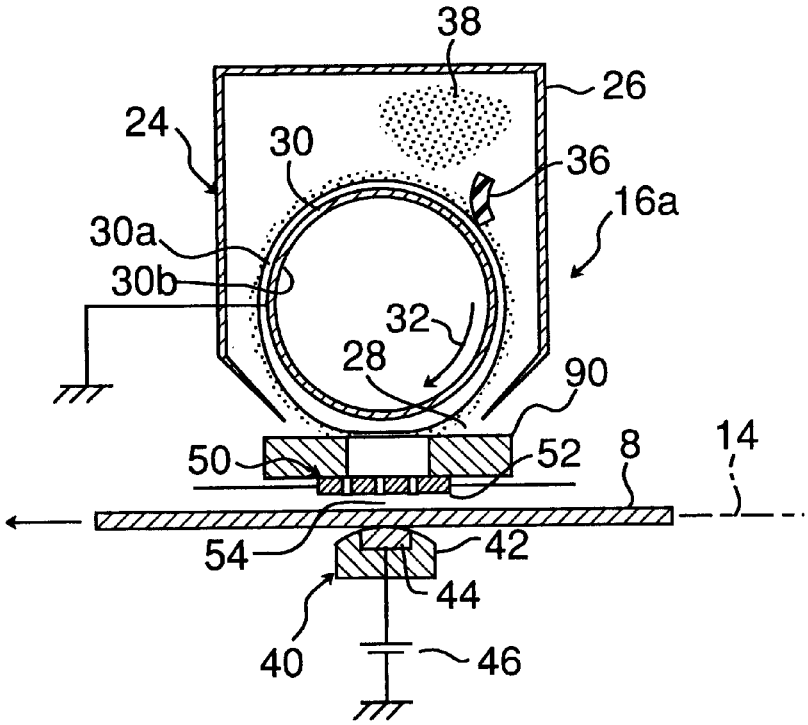
FIG. 2 is a cross-sectional side elevational view of a printing station.
Figure 4:
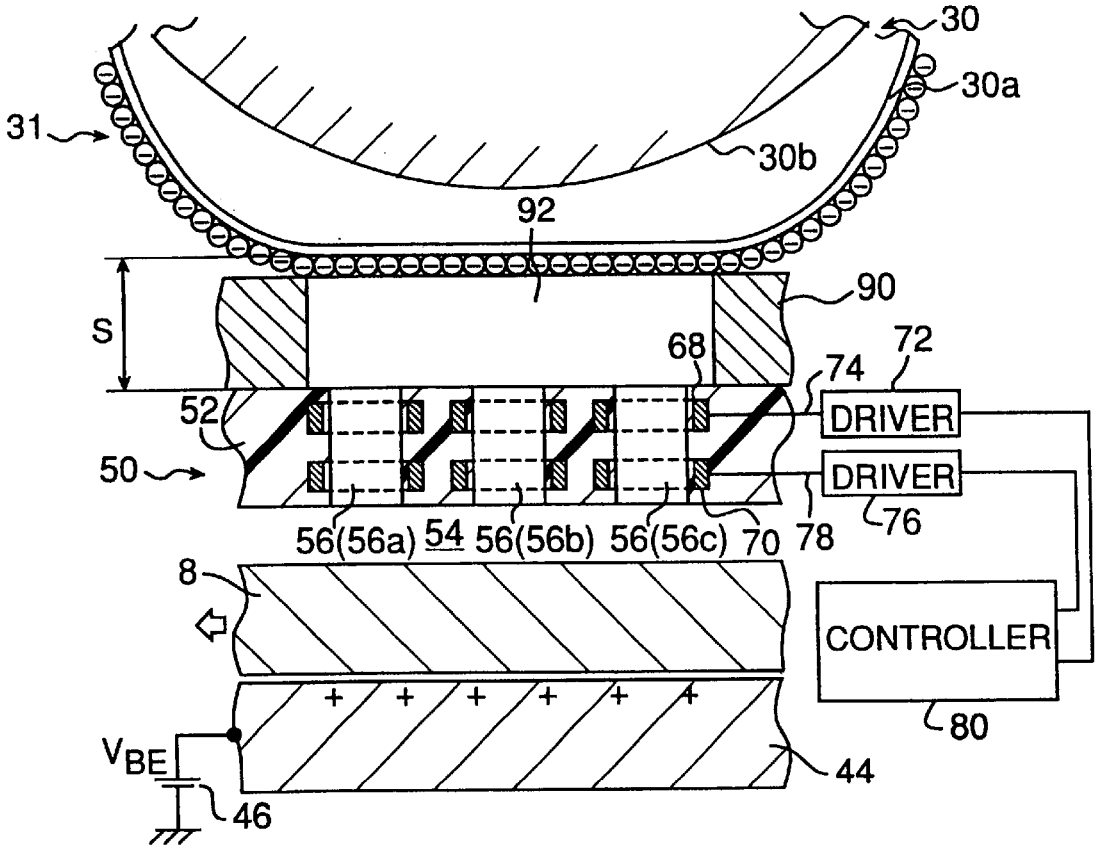
FIG. 4 is a enlarged fragmentary cross-sectional view of the printing head, developing roller and backing electrode taken along a line IV—IV in FIG. 3.

Referring to FIG. 2, the printing station 16 comprises a developing device generally indicated by reference numeral 24 above the sheet passage 14. The developing device 24 comprises a container 26 which has an opening 28 confronting the sheet passage 14. Adjacent the opening 28, a developing roller 30 is provided. The developing roller 30 comprises a sleeve 30*a* as a bearing member of printing particles according to the present invention and a drive roller 30*b*. The sleeve 30*a* has an endless or cylindrical shape having a thickness of 0.15 mm and a diameter of 20 mm and is made of flexible and conductive material such as nickel, nylon or so. The drive roller 30*b* is contained in the sleeve 30*a* and supported for rotation in a direction indicated by an arrow 32. The outer diameter of the drive roller 30*b* is smaller than the inner diameter of the sleeve 30*a* so that the sleeve 30*a* is formed with a slack 31 as shown in FIG. 4. The slack 31 comes into contact with a spacer 90 that will be explained hereinafter. The drive roller 30*b* is made of conductive material and is electrically connected to the earth. Alternatively, the sleeve 30*a* can be electrically connected to the earth. A blade 36, preferably made from a plate of elastic material such as rubber or stainless steel, is disposed in contact with the sleeve 30*a*.

The container 26 accommodates printing particles, i.e., toner particles 38. In this embodiment, the toner particles having a volume mean particle size of 8$\mu$ and capable of being charged with negative polarity are used.

Disposed under the developing device 24, beyond the sheet passage 14, is an electrode mechanism generally indicated by reference numeral 40 which includes a support 42 made of electrically insulative material and a backing electrode 44 made of electrically conductive material. The backing electrode 44 is electrically connected to a direct power supply 46 which supplies a voltage of predetermined polarity (positive polarity in this embodiment) so that the backing electrode 44 is provided with, for example, a voltage of +1200 volts. Thus, between the backing electrode 44 and the developing roller 30 are formed an electric field E that the negatively charged toner particles 38 on the developing roller 30 are electrically attracted to the backing electrode 44.

Fixed between the developing device 24 and the electrode mechanism 40 and above the sheet passage 14 is a printing head generally indicated by reference numeral 50. Preferably, the printing head 50 is made from a flexible printed circuit board 52, having a thickness of about 50 to 150 micrometers. As shown in FIG. 2, a portion of the printing head 50 located in a printing zone where the developing roller 30 confronts the backing electrode 44 includes a plurality of apertures 56 having a diameter of about 25 to 200 micrometers which is substantially larger than an average diameter (about several micrometers to a dozen micrometers) of the toner particles 38.

Figure 3:
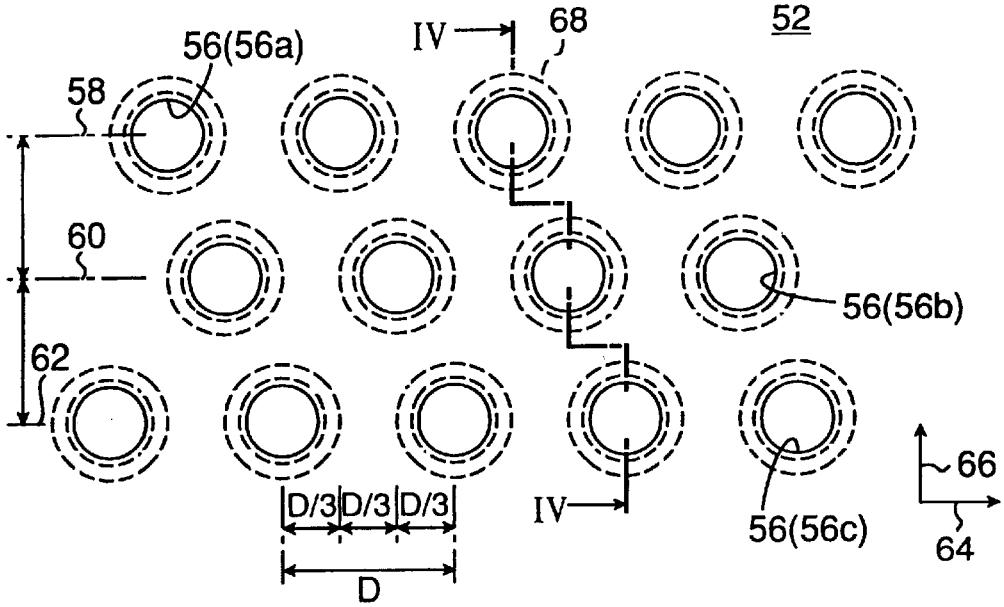
FIG. 3 is an enlarged fragmentary plane view of a printing head.

In this embodiment, as best shown in FIG. 3, the apertures 56 are formed on equally spaced three parallel lines 58, 60 and 62 each extending in a direction indicated by reference numeral 64 which is parallel to an axis of the developing roller 30 and perpendicular to a direction indicated by reference numeral 66 along which the sheet 8 will be transported, ensuring the printing head 50 with a resolution of 600 dpi. The apertures 56 on the lines 58, 60 and 62 are formed at regular intervals of D, e.g., 127 micrometers, and the apertures 56(56*a*) and 56(56*c*) on the lines 58 and 62 are shifted by the distance D/N to the opposite directions with respect the apertures 56(56*b*) on the central line 60, respectively, so that, when viewed from the sheet transporting direction 66, the apertures 56 appear to be equally spaced. Note that the number N represents the number of line rows and is "3" in this embodiment, however, the number N as well as the interval D can be determined depending upon the required resolution of the print head.

The flexible printed circuit board 52, as shown in FIG. 4, further includes therein doughnut-like first and second electrodes 68 and 70 each of which surrounds the apertures 56. The first electrode 68 is disposed on one side opposing the developing roller 30 while the second electrode 70 is on the other side opposing the backing electrode 44.

The first electrode 68 is electrically communicated with a driver 72 through a printed wire 74 and the second electrode 70 is electrically communicated with a driver 76 through a printed wire 78, so that the drivers 72 and 76 can transmit image signals to the first and second electrodes 68 and 70, respectively. The drivers 72 and 76 are in turn electrically communicated with a controller 80 that feeds out data of image to be reproduced by the printing device 2.

The image signals to be transmitted to the first and second electrodes 68 and 70 consist of a DC component constantly applied to the first and second electrodes 68, 70 and a pulse component applied to the first and second electrodes 68, 70 in response to the image data from the controller 80 for forming dots on the sheet 8.

In the concrete, in this embodiment, for the first electrode 68, the base voltage V1(B) is about −50 volts, and the pulse voltage V1(P) is about +300 volts. For the second electrode 70, the base voltage V2(B) is about −100 volts and the pulse voltage V2(P) is about +200 volts.

Between the developing roller 30 and the printing head 50 is disposed a spacer 90. The spacer 90, as shown in FIG. 4, is positioned at the upper side of the printing head 50 opposing to the developing roller 30. At a position opposing to the portion in which the apertures 56 of the printing head 50 is formed, the spacer 90 is formed with a slit 92 extending to the main scanning direction (perpendicular to the surface of the drawing). The slack 31 of the sleeve 30*a* of the developing roller 30 comes into contact with the spacer 90 so that the slack 31 is opposed to the slit 92 in a flat condition. Thus, the distance S between the sleeve 30*a* and the printing head 50 is held stable even if the drive roller 30*b* has an eccentricity or looseness.

Figure 5:
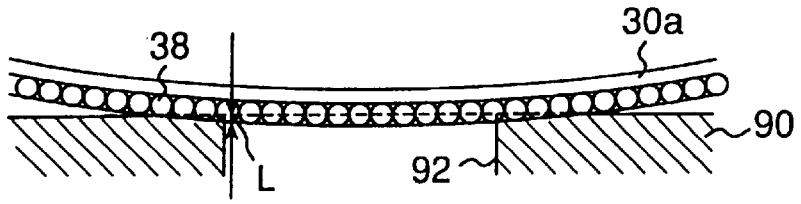
FIG. 5 is an enlarged fragmentary cross-sectional view of the spa r and the developing roller during printing operation.

In this embodiment, the spacer 90 is made of a material which is apt to be worn by the toner particles 38, such as polyethylene terephthalate, fluoroplastic or the likes. In other words, the spacer 90 is made of a softer material than the toner particles 38. Particularly, the spacer 90 is made of such a material that, as shown in FIG. 5, maximum wearing depth L ($\mu$m) per unit moving distance (m) of the developing roller 30 rotating with the toner particles 38 born thereon is more than $2.0\times10^{-3}$ $\mu$m/m.

Having described the construction of the printing device 2, its operation will now be described.

As shown in FIG. 2, in the printing station 16, the drive roller 30*b* of the developing roller 30 rotates in the direction indicated by the arrow 32, allowing the sleeve 30*a* to rotate in the same direction. The toner particles 38 are deposited on the sleeve 30*a* and then transported into a contact region of the blade 36 and the sleeve 30*a* where the toner particles 38 are provided with triboelectric negative charge by the frictional contact of the blade 36. Thereby, as shown in FIG. 4, incremental peripheral portions of the developing roller 30 which has passed through the contact region bear a thin layer of charged toner particles 38.

The slack 31 of the sleeve 30*a* of the developing roller 30 comes into contact with the spacer 50, whereby the slack 31 is opposed to the slit 92 in a flat condition. Thus, the distance S between the sleeve 30*a* and the printing head 50 is held stable even if the drive roller 30*b* has an eccentricity or looseness.

The sleeve 30*a,* with the toner particles 38 born thereon, of the developing roller 30 rotates in a condition that it comes into contact with the spacer 90 via the toner particles 38, whereby a load due to the contact is applied to the spacer 90. In the conventional apparatus, the toner particles 38 are accumulated in the contact portion. In the present embodiment, on the other hand, since the spacer 90 is made of a material which is apt to be worn by the toner particles 38, the toner particles 38 reach the slit 92 of the spacer 90 while wearing away the spacer 90. Thus, as shown in FIG. 5, the toner particles 38 never accumulate in the contact portion, preventing the toner particles from adhering to the surface of the spacer.

In the printing head 50, the first and second electrodes 68 and 70 are constantly biased to the base voltage V1(B) of about −50 volts and V2(B) of about −100 volts. Therefore, the negatively charge toner particle 38 on the sleeve 30*a* of the developing roller 30 electrically repels against the first and second electrodes 68 and 70 and therefore stays on the sleeve 30*a* without propelling toward the aperture 56.

The controller 80 outputs the image data corresponding to an image to be reproduced to the drivers 72 and 76. In response to the image data, the drivers 72 and 76 supplies the respective voltages V1(P) of about +300 volts and V2(P) of about +200 volts to the pairs of first and second electrodes 68 and 70. As a result, the toner particles 38 on the portions of the sleeve 30*a* confronting the biased electrodes are electrically attracted by the first and second electrodes 68 and 70. This energizes a number of toner particles 38 to propel by the attraction force of the backing electrode 44 into the opposing aperture 56.

When the toner particles 38 have reached respective positions adjacent to the first and second electrodes 68 and 70, the voltages to be applied to the first and second electrodes 68 and 70 are changed from the pulse voltages V1(P) and V2(P) to base voltages V1(B) and V2(B), at respective timings. As a result, the toner particles 38 in the aperture 56 are then forced radially inwardly by the repelling force from the first and second electrodes 68 and 70 applied with the base voltages V1(B) and V2(B), respectively, and then converged into a mass. The converged mass of the toner particles 38 are then deposited on the sheet 8 which is moving past the printing zone 54, thereby forming a layer of the toner particles on the sheet 8. The aforementioned second electrode 70 is provided mainly for the purpose of converging the mass of the toner particles 38. Therefore, the second electrode 70 can be excluded if necessary. The second electrode 70 may be a shape divided from the doughnut-like shape to control the flying direction of the mass of the toner particles 38.

Subsequently, the sheet 8 to which the image consists of the layers of the toner particles 38 is formed is transported in the fusing station 18 where the layers of the toner particles 38 are fused and permanently fixed on the sheet 8 and finally fed out onto the final stack station or catch tray 20.

Figure 6:
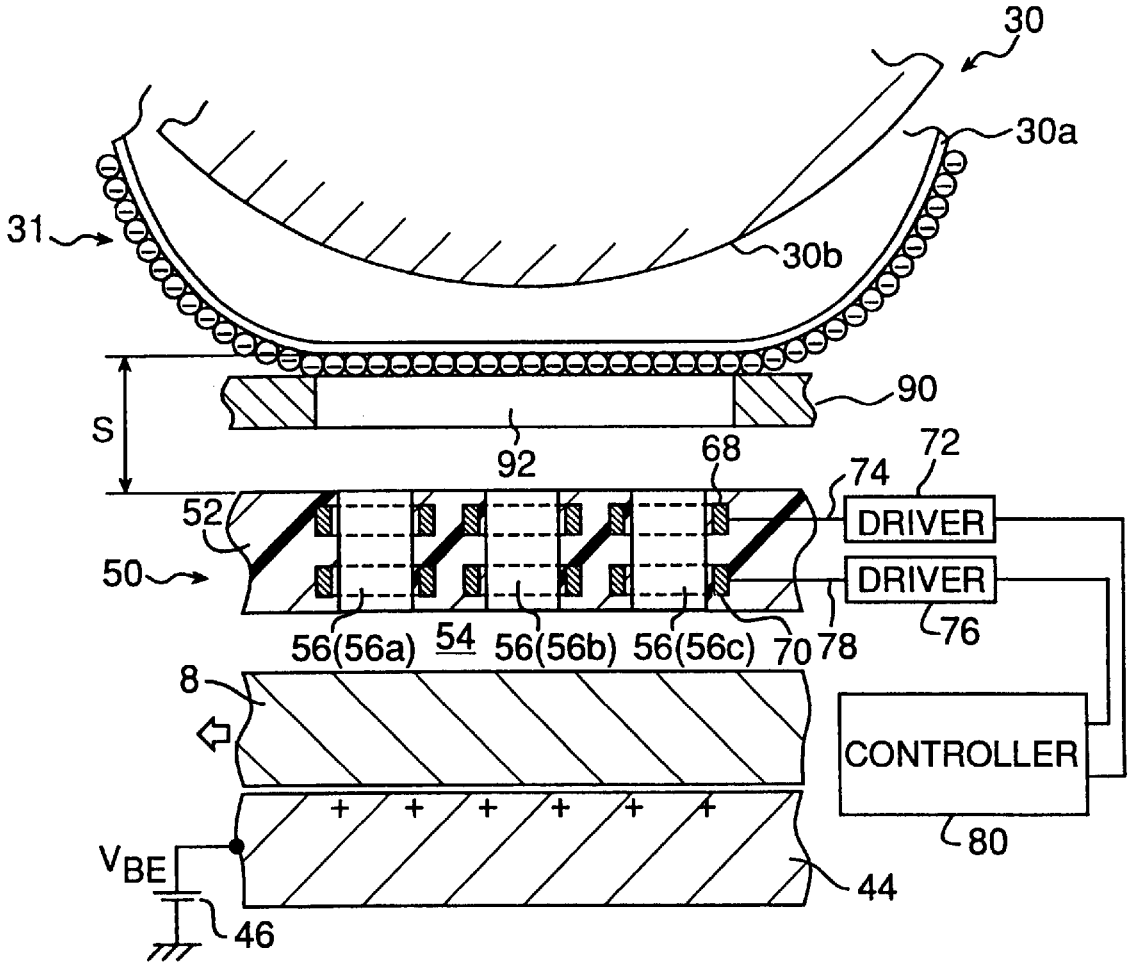
FIG. 6 is an enlarged fragmentary cross-sectional view showing a variation of the first embodiment of the tandem type direct printing apparatus.

Alternatively, the spacer 90 in the direct printing apparatus 2 of the aforementioned first embodiment may have a plate-like shape as shown in FIG. 6 and may be disposed such that it comes into contact with only the sleeve 30*a* of the developing roller 30.

Figure 7:
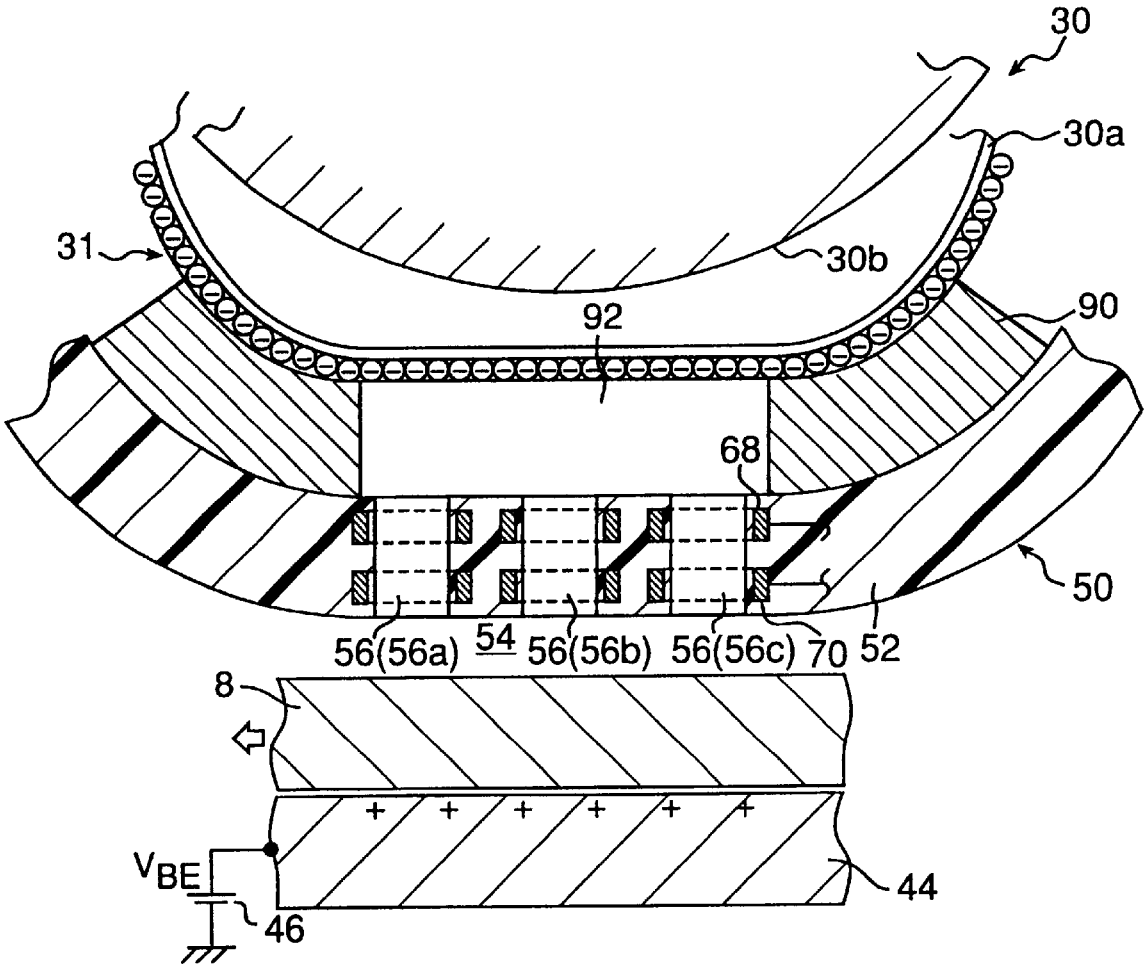
FIG. 7 is an enlarged fragmentary cross-sectional view of a second embodiment of a tandem type direct printing apparatus of the present invention.

FIG. 7 shows a direct printing apparatus, generally indicated by reference numeral 2, according to the second embodiment of the present invention. The second embodiment is different from the first embodiment in that the printing head 50 and the spacer 90 constitute a flexible printed circuit board 52 which is bent and disposed along the slack 31 of the sleeve 30*a* of the developing roller 30.

In the direct printing apparatus 2 of the second embodiment, the melting of the toner particles 38 and the adhesion thereof to the spacer 90 can be prevented in the same manner as the first embodiment. Furthermore, a distance between the sleeve 30*a* of the developing roller 30 and the printing head 50 can be kept constant over the whole range, enabling to propel the toner particles 38 in more stable condition.

Although the aforementioned embodiments were explained as to a monochrome type of direct printing apparatus having a single developing device, the present invention is also applicable to a tandem type of color direct printing apparatus in which a plurality of printing stations are disposed in a sheet moving direction.

In the shown embodiments, although the spacer 90 itself is made of a material which is apt to be worn by the toner particles 38, the spacer 90 may be made of conventional material and coated with such a material that is apt to be worn by the toner particles. In the case that the spacer 90 is made of resin, it may be formed by two color injection molding.

In the aforementioned embodiments, although the printing station in the above embodiments is a type of one component system using only the toner particles 38, a type of two components system using both toner and carrier may be also applicable.

In the aforementioned embodiments, although the printing particles bearing means is a type comprising a hard roller and a flexible sleeve, a type of double rollers may be also applicable.

In the aforementioned embodiments, although the electrodes (apertures) of the printing head 50 are provided in three lines along the longitudinal direction of the a developing roller 30, they may be provided in at least one line. In the case of a plurality of lines, the pitch of the apertures 56 can be set based on the required resolution.

Although the present invention has been fully described by way of the examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

EXPERIMENTAL EXAMPLE

In order to certify the result of the direct printing apparatus according to the present invention, the inventor made an experiment as explained hereinafter. In this experiment, the apparatus of the second embodiment as shown in FIG. 7 was used. A chart having an image ratio of 5% was continuously printed under the following conditions. Existence and nonexistence of image noise due to the toner adhesion to the surface of the spacer was confirmed. The wearing amount of the spacer after printing 3000 sheets (sleeve moving distance: 4400 m) was measured. Table 1 shows the results.

Set condition of the apparatus:

System velocity;
38 mm/sec

Distance between developing roller and printing head;
80$\mu$

Aperture diameter;
100$\mu$

Total number of apertures;
2480 dot (A4 width) disposed in 6 lines

Electric potential of developing roller;
Vr=0 (volt)

Electric potential of control electrode;
Vb=350 (volt) at printing time
Vw=0 (volt) at non-printing time Electric potential of backing electrode;
VBE=1300 (volt)

1 line printing time;
$T_{total}$=Tb(Vb applying time)+Tw(Vw applying time)
Where,
Tb=700 $\mu$sec
Tw=1530 $\mu$sec Toner:

Volume mean particle size;
8$\mu$ (negatively chargeable toner)

Printing station:

Developing device;
Single component type

Drive roller;
Conductive EPDM
Diameter 38 mm

Nickel sleeve;
Resistance 1×10E6 Ω.m
Diameter 40 mm
Circumferential velocity of roller 72 mm/sec Samples:

Sample A; aramid

Sample B; PET

Sample C; fluoroplastic (conductive type)

Sample D; fluoroplastic (insulative type)

Where, coating thickness is 0.05 mm.

Line pressure of the developing roller to the printing head:
P=2 gf/mm

TABLE 1

| | Maximum Wearing Amount ($\mu$m) | Image Noise | Wearing Amount per Unit Moving Distance ($\mu$m/m) |
|---|---|---|---|
| Sample A | 3 | X | 0.00068 |
| Sample B | 16 | ○ | 0.0036 |
| Sample C | 25 | ○ | 0.0057 |
| Sample D | 40 | ○ | 0.0091 |

As shown in Table 1, in the case of sample A having large hardness relatively to the toner particles 38, it was confirmed that the maximum wearing amount (depth) per unit moving distance of the developing roller was small, that the toner particles 38 were melted and adhered to the spacer 90, and that an image noise was generated on the printed sheet 8. On the other hand, in the case of sample B, c and D having small hardness, it was confirmed that the maximum wearing amount (depth) per unit moving distance was large and that no image noise was generated on the printed sheet 8, resulting in no problem.

What is claimed is:

1. A direct printing apparatus which comprises a bearing member for bearing printing particles thereon, the printing particles being charged to a predetermined polarity, a backing electrode opposed to the bearing member, and a printing head disposed between the bearing member and the backing electrode, the printing head having a plurality of apertures through which the printing particles can propel and a plurality of electrodes disposed around the plurality of apertures, whereby the printing particles are directly deposited on a print medium which is conveyed between the backing electrode and the printing head, wherein:

a positioning spacer is provided between the bearing member and the printing head so that the surface of the bearing member comes into contact with the spacer; and at least a part of the spacer which comes into contact with the bearing member is made of a material which is apt to be worn by the printing particles.

2. The direct printing apparatus as claimed in claim 1, wherein the part of the spacer which comes into contact with the bearing member is made of such a material that maximum wearing depth per unit moving distance of the bearing member is more than $2.0\times10^{-3}$ $^{\mu}$m/m.

3. The direct printing apparatus as claimed in claim 1, wherein the bearing member comprises an endless sleeve for bearing the printing particles thereon and a drive roller having outer diameter smaller than the inner diameter of the sleeve and being disposed in the sleeve.

* * * * *